US005875731A

United States Patent [19]

Abernethy et al.

[11] Patent Number: 5,875,731

[45] Date of Patent: Mar. 2, 1999

[54] COLLAPSIBLE BOAT

[76] Inventors: Dwight W. Abernethy, 143 Nokomis Cres, Saskatoon, Saskatchewan, Canada, S7K 5C9; Gordon E. Espeseth, 1326—13th St.E, Saskatoon, Saskatchewan, Canada, S7H 0C6

[21] Appl. No.: 826,029

[22] Filed: Mar. 28, 1997

[51] Int. Cl.[6] ..... B63B 35/00

[52] U.S. Cl. ..... 114/354; 114/347

[58] Field of Search ..... 114/352–354, 347

[56] References Cited

U.S. PATENT DOCUMENTS

| | | | |
|---|---|---|---|
| 339,817 | 9/1886 | King . | |
| 1,649,311 | 11/1927 | Kaechele et al. . | |
| 1,822,810 | 9/1931 | Hart | 114/354 |
| 2,415,495 | 2/1947 | Humphreys . | |
| 3,123,841 | 3/1964 | Bronner . | |
| 3,869,743 | 3/1975 | Brown et al. . | |
| 4,004,307 | 1/1977 | Hermann . | |
| 4,057,865 | 11/1977 | Trautwein . | |
| 4,274,170 | 6/1981 | Simpson . | |
| 4,407,216 | 10/1983 | Masters . | |
| 4,480,579 | 11/1984 | Masters . | |
| 4,841,899 | 6/1989 | Fleckles et al. . | |

*Primary Examiner*—Ed Swinehart

*Attorney, Agent, or Firm*—Townsend and Townsend and Crew LLP

[57] ABSTRACT

A collapsible boat having a framework comprising forward and aft keel member portions, forward and aft port and starboard gunwale member portions, forward and aft port and starboard stringer member portions, and a plurality of cross-rib members. The keel, gunwale and stringer member portions are joined by interconnecting members into aligned longitudinal members that are also interconnected to the cross-rib members to create forward and aft hull sections. A keel locking and tensioning mechanism is used to join together the forward and aft hull sections at the keel to define a hull framework having elongate keel, gunwale and stringer members that extend longitudinally between a bow and stern and that are spaced and braced by transversely extending cross-rib members. A rocker adjustment system in the gunwale member portions joins the forward and aft gunwale members and permits variation of the elevation of the bow and stern of the framework by adjusting the overall length of the gunwale member portions. The framework is insertable into a flexible water impermeable skin to create a boat with adjustable handling characteristics suitable for use in a wide variety of sailing conditions and environments.

21 Claims, 5 Drawing Sheets

COLLAPSIBLE BOAT

FIELD OF THE INVENTION

This invention relates to a collapsible boat in which a skin or shell of waterproof material covers a collapsible internal framework of rigid members.

BACKGROUND OF THE INVENTION

Collapsing or foldable boats such as kayaks or canoes are well known and have been commercially available for many years. Applicant is aware of the following patents which disclose water craft that are designed to be collapsed from a watergoing form into a relatively compact form for storage and/or transportation:

U.S. Pat. No. 389,817 to King

U.S. Pat. No. 1,649,311 to Kaechele

U.S. Pat. No. 2,415,495 to Humphreys

U.S. Pat. No. 3,123,841 to Bronner

U.S. Pat. No. 3,869,743 to Brown

U.S. Pat. No. 4,004,307 to Hermann

U.S. Pat. No. 4,057,865 to Trautwein

U.S. Pat. No. 4,274,170 to Simpson

U.S. Pat. No. 4,407,216 to Masters

U.S. Pat. No. 4,480,579 to Masters

U.S. Pat. No. 4,841,899 to Fleckles

The foregoing patents that relate specifically to collapsible kayaks or canoes tend to rely on a series of bulky ribs or formers to space and support the longitudinal frame members and define the cross-sectional shape of the assembled hull. This arrangement divides the assembled hull into compartments defined by inwardly protruding ribs that makes loading of gear into the interior of the hull difficult if not impossible. Loading of gear into the hull is an important consideration as it is often the only way for a user to transport their gear with them.

In addition, except for the Masters' patents which rely on a relatively crude scheme for adjusting the keel curvature or rocker, the foregoing patents disclose hulls having a fixed rocker. It is advantageous and desirable to have a vessel that can be adapted to handle different water conditions by varying the rocker.

SUMMARY OF THE INVENTION

Applicant has developed a collapsible boat that addresses some of the limitations and disadvantages of prior designs. The present invention provides a collapsible boat that uses a system of interconnectable longitudinal members and transverse ribs to form a collapsible framework that contains no internal dividers to limit gear storage. In addition, the framework incorporates a system that permits quick and efficient adjustment of the hull rocker to adjust the handling characteristics thereby rendering the boat of the present invention sufficiently versatile to handle many types of water conditions.

Accordingly, the present invention provides a collapsible boat having a framework comprising:

forward and aft keel member portions;

forward and aft port and starboard gunwale member portions;

forward and aft port and starboard stringer member portions;

a plurality of transverse cross-rib members;

interconnecting means for joining of the keel, gunwale and stringer member portions into aligned longitudinal members joined at adjacent ends and for joining of the longitudinal members to the cross-rib members to define forward and aft hull sections;

a keel locking and tensioning mechanism to join together the forward and aft keel members and thereby the forward and aft hull sections to define a framework having elongate keel, gunwale and stringer members that extend longitudinally between a bow and stern and that are spaced and braced by the transverse cross-rib members; and a rocker adjustment system in the gunwale members to join together the forward and aft gunwale member portions and permit variation of the elevation of the bow and stern of the framework by adjusting the overall length of the gunwale members.

The framework is insertable into a flexible water impermeable layer or skin that is shaped to receive the forward and aft portions of the framework through a central cockpit opening. The forward and aft portions of the hull are then joined at the keel by the keel locking and tensioning mechanism. Finally, the rocker adjustment mechanism is used to adjust the length of the gunwale members to select the desired rocker of the keel.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
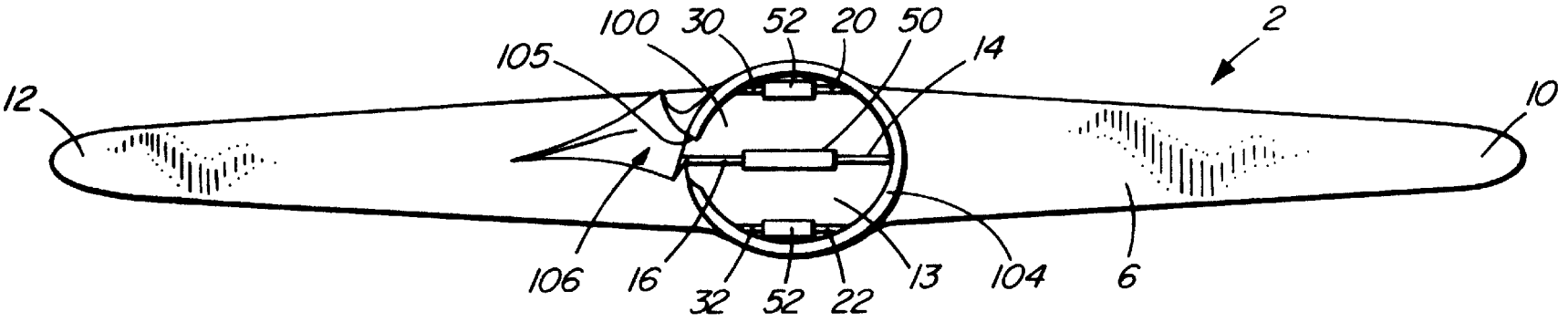
FIG. 1 is a plan view of a kayak hull constructed according to a preferred embodiment of the present invention.
Figure 2:
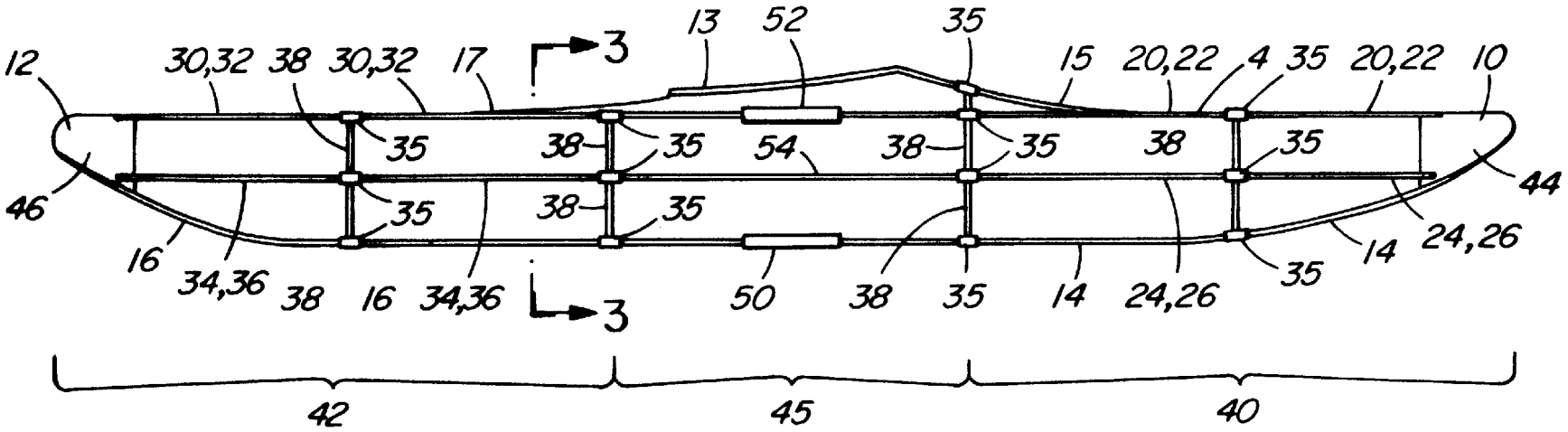
FIG. 2 is an elevation view of the kayak hull of FIG. 1 with the covering layer removed to show the underlying framework.

Referring to FIGS. 1 and 2, there is shown a kayak 2 and a kayak internal framework 4 constructed according to a preferred embodiment of the present invention. In FIG. 1, the framework 4 is covered by a flexible water impermeable layer or skin 6 that is formed to conform to the shape of the framework. The kayak 2 has a bow 10 and a stern 12 and a central cockpit 13.

Internal framework 4 is formed from a plurality of longitudinal members including forward and aft keel member portions 14 and 16, port and starboard forward gunwale member portions 20 and 22 and port and starboard forward stringer members 24 and 26. As best shown in the hull cross-section of FIG. 3, the framework also includes port and starboard aft gunwale member portions 30 and 32 and port and starboard aft stringer members 34 and 36.

The various forward and aft keel, gunwale and stringer member portions are joined end to end at connections 35 into aligned elongate longitudinal members that define forward and aft hull sections 40 and 42, respectively. Cross-ribs 38 extend transversely between connections 35 to brace and space the longitudinal members. In the kayak configuration illustrated, forward and aft elongate deck members 15 and 17, respectively, are also provided between forward and aft port and starboard gunwale member portions 20,22 and 30,32 to support skin 6 over the top of the framework. It will be readily apparent to those skilled in the art that the framework structure of the present invention is not limited to use in a kayak. The internal framework of the present invention can be readily designed to define the hull other small water vessels such as a canoe, however, for the purposes of illustration only, the embodiment described is a kayak.

Forward and aft hull sections 40 and 42 include a bow or stern plate 44 and 46, respectively, to which the gunwale, stringer and deck members are releasably fastened. Plates 44 and 46 are preferably rigidly attached by welding to the ends of the outermost keel member portions 16. The plates are suitably shaped to define a smoothly rounded bow and stern to the kayak beneath skin 6. Adjacent keel, gunwale, deck and stringer member portions for connection end-to-end are preferably joined by elastic cords (not shown) so that the various member portions can remain connected by the cords when the framework is collapsed into component parts to prevent losing parts. All the longitudinal members and cross-rib members are preferably aluminum alloy tubes selected for their lightweight, strength and corrosion resistance.

The forward and aft hull sections 40 and 42 are joined in the cockpit region 45 of the kayak by a keel locking and tensioning mechanism 50 that joins together the forward and aft keel members 14 and 16, respectively. In addition, as best shown in FIG. 1, rocker adjustment systems 52 join together the port forward and aft gunwale member portions 20 and 30 and the starboard forward and aft gunwale member 22 and 32. The rocker adjustment systems 52 permit variation of the elevation of the bow and stern of the framework by adjusting the overall length of the gunwale members as will be described. Port and starboard telescoping stringer members 54 join together the port and starboard forward and aft stringer member portions 24, 26 to 34, 36. The result is an assembled framework as illustrated in FIG. 2 that defines a hull having elongate keel, gunwale and stringer members that extend longitudinally between bow 10 and stern 12 and that are spaced and braced by the transverse cross-rib members 38.

Figure 4:
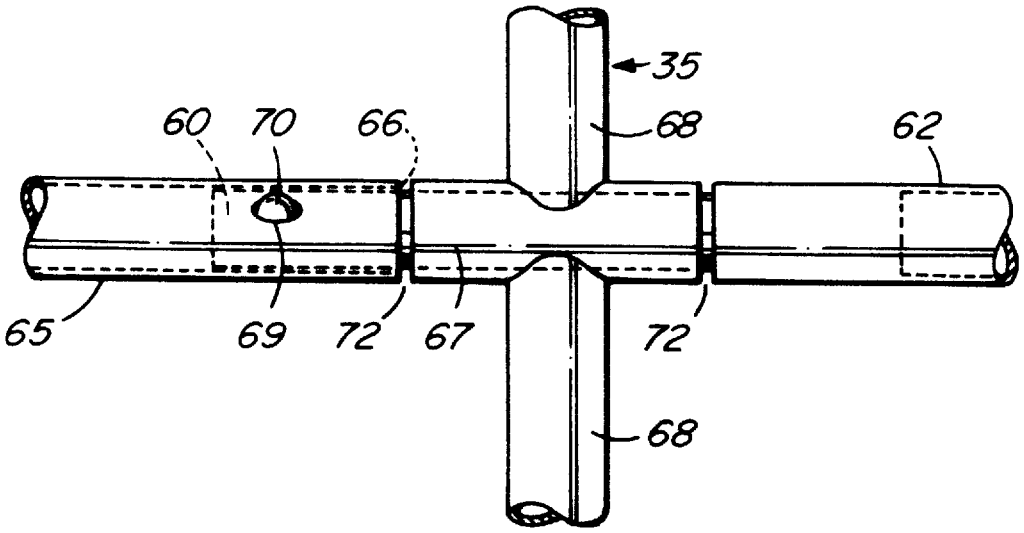
FIG. 4 is a detail view showing the interconnection for joining of the longitudinal members and the cross-ribs of the framework.

Referring to FIG. 4, there is shown a detail view of a typical connection 35 for joining various longitudinal member portions end to end and to transverse cross-rib members 38. Each connection 35 comprises an end of a first portion 62 of a longitudinal member having a male portion 60 and an adjacent end of a second portion 65 of the longitudinal member having a complementary opening 66 to serve as the female portion to receive the male portion therein. A sleeve 67 is slidably received on male portion 60 and has a pair of radially extending tubes 68 to receive a pair of cross-rib members 38. Tubes 68 are rigidly attached to sleeve 67 and extend at set angles depending on the location of the sleeve in the overall hull framework.

Figure 3:
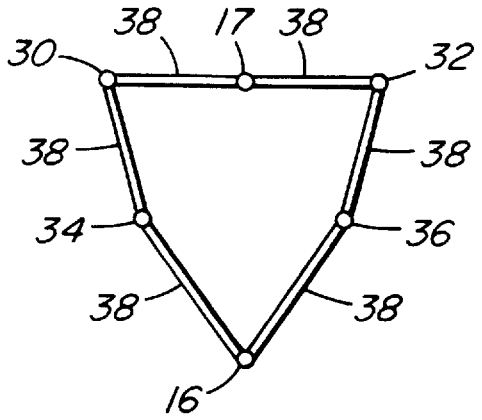
FIG. 3 is a representative section view through the framework taken along line 3—3 of FIG. 2.

The foregoing connection arrangement does not require the use of formers or inwardly extending ribs as in many prior collapsible boat designs. As shown in FIG. 3, the interior 68 of the hull framework is clear of any obstructions to allow easy and efficient loading and stowage of gear within the hull.

In some cases, particularly in the gunwale members, it is necessary to lock together the male and female portions of each interconnection 35 to permit adjustment in the overall length of a gunwale member. In other longitudinal members, it is generally permissible for male portion 60 to move within receiving opening 66 and sleeve 67 to slide along male portion 60 to accommodate flexing of the framework, and a locking mechanism is not necessary. In FIG. 4, a locking mechanism is illustrated comprising an opening 69 in female portion and a depressible protrusion or button 70 formed on the male portion that is spring biased to protrude outwardly from the male portion. When male portion 60 is inserted into receiving opening 66, button 70 extends into opening 69 to lock the male and female portion together on alignment of opening 69 and button 70.

Sleeve 67 is mounted between the male and female portions of the connection and the male and female portions are formed with end flanges 72 that co-operate to define a region therebetween to limit movement of the sleeve.

Figure 5:
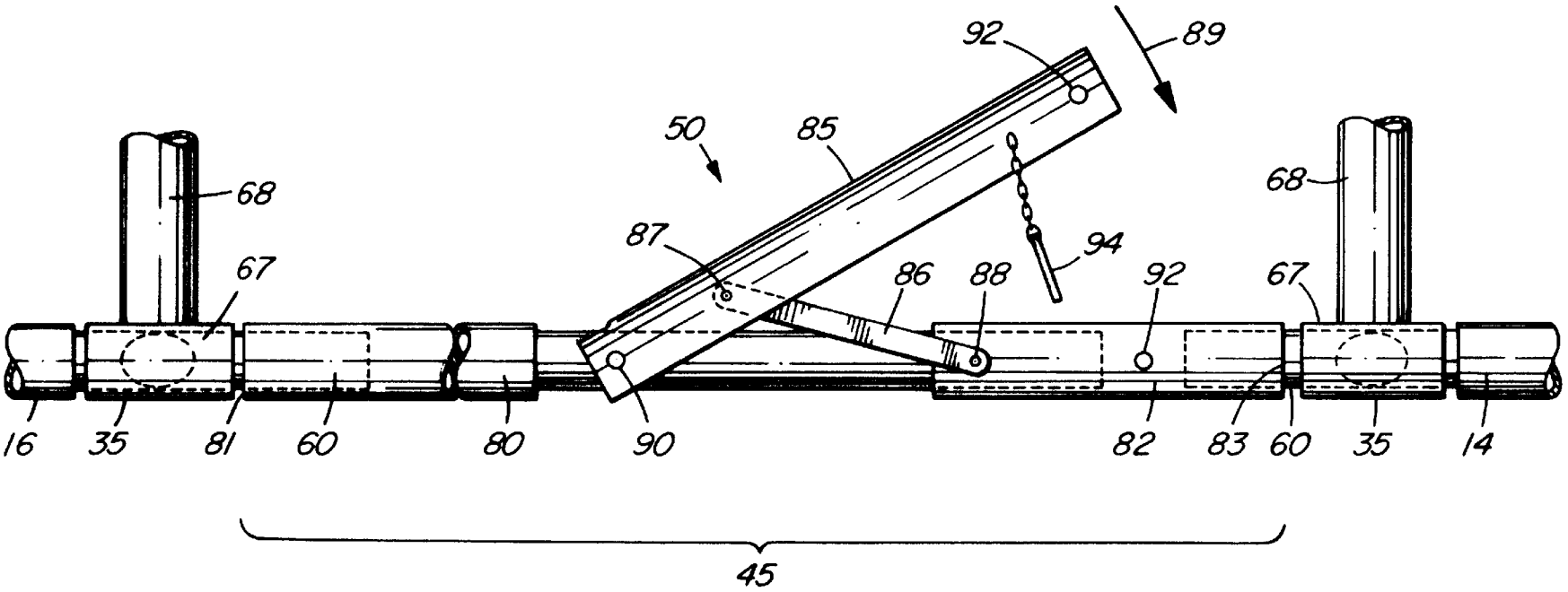
FIG. 5 is a detail view of the keel locking and tensioning mechanism of the present invention.

Referring to FIG. 5, there is shown the keel locking and tensioning mechanism 50 of the present invention in plan view. Mechanism 50 is a telescoping member that is insertable between and connectable to the forward and aft keel member portions 14 and 16, respectively. Male portions 60 of keel member portions 14 and 16 engaged in sleeves 67 of connections 35 extend into cockpit region 45 of the hull framework and serve as attachment points for keel locking and tensioning mechanism 50. Mechanism 50 is expandable from a contracted position to allow for insertion between forward and aft male portions 60 into an extended position to engage with the male portions and connect together the forward and aft keel member portions 14 and 16.

Mechanism 50 includes an elongate member 80 defining a first end of the telescoping member with a cavity 81 to receive the male portion 60 of an end of a keel member portion 16. The second end of the telescoping member is defined by a sleeve 82 received on the elongate member for movement along the elongate member. Sleeve 82 includes an open end 83 adapted to engage with the male portion of an end of keel member portion 14. A lever arm 85 is pivotally mounted at joint 90 to elongate member 80 and includes a link 86 extending between the lever arm and the sleeve. Link 86 is mounted for pivotal movement at connection points 87 and 88. Pivotal movement of lever arm 85 downwardly about joint 90 in the direction of arrow 89 acts to move sleeve 82 along elongate member 80 to effectively increase the length of the keel locking and tensioning mechanism to engage the protruding male portions 60 at either end and create a completed keel member through the cockpit region 45. Lever arm 85 and sleeve 82 are formed with holes 92 that are alignable when lever arm 85 is pivoted to a lowermost position parallel to the keel. A locking pin 94 is insertable through aligned holes 92 to lock mechanism 50 into its extended position. Lever arm 85 preferably has a tubular cross-section so that the lever arm neatly fits over elongate member 80 and sleeve 82 when moved to its lowermost position.

When assembling the collapsible kayak of the present invention, the forward and aft hull sections 40 and 42 are constructed initially and inserted into the ends of skin 6 as illustrated in FIG. 1. Skin 6 is formed with a central cockpit opening 100 surrounded by annular coaming member 104 formed integrally with skin 6. Annular coaming member 104 is flexible and formed with a releasable joint 105 to allow the annular coaming member to be opened and spread apart to create an opening sufficiently large to receive the forward and aft hull section 40 and 42. A gusset 106 extends from central cockpit opening 10 at a point adjacent releasable joint 105 in the coaming member to provide excess material to allow for enlargement of the cockpit opening. Once the forward and aft hull sections are inserted into skin 6, gusset 106 is folded and coaming member 104 is resealed at joint 105.

Many other collapsible kayak designs must assemble or attach the coaming to the skin each time the kayak is assembled. By forming the coaming as an integral part of the skin, assembly speed is increased and the potential for leakage of water at the coaming is effectively eliminated.

After the forward and aft hull sections have been inserted into skin 6, the keel locking and tensioning mechanism in its retracted state is then inserted through cockpit opening 100 into place between the forward and aft keel portions. Lever 85 is actuated by hand to enlarge mechanism 50 into its expanded position to engage with the forward and aft keel portions. Besides connecting the forward and aft hull sections, mechanism 50 is also dimensioned to move the forward and aft portions of the framework apart into the ends of the skin to tauten the skin over the framework in order to carryout the tensioning function of the mechanism and provide longitudinal tightening of the skin. Installation of keel locking and tensioning mechanism 50 locks the keel at a pre-determined length in preparation for the next step in the assembly process.

Figure 6:
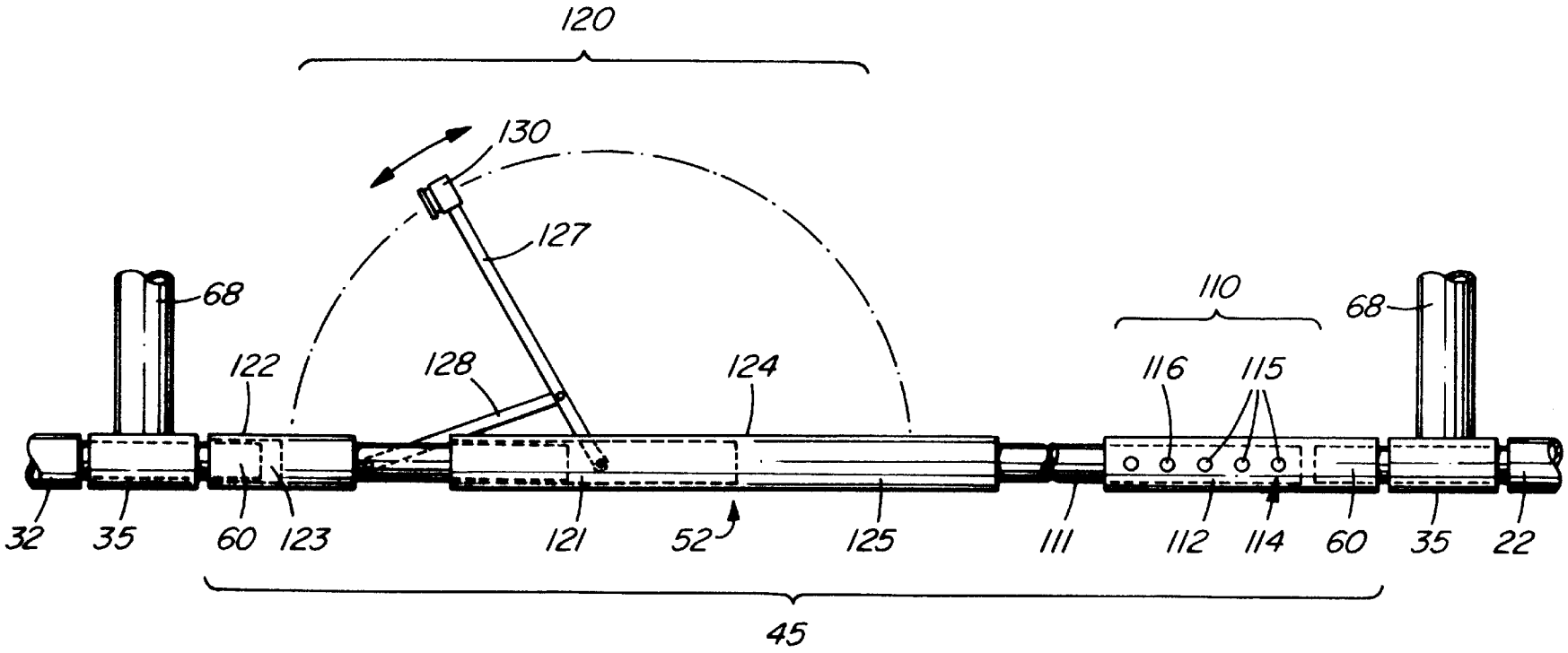
FIG. 6 is a detail view of the rocker adjustment system of the present invention.

Once keel locking and tensioning mechanism 50 is installed, the next step is to install the port and starboard rocker adjustment systems 52 to complete the gunwale members through cockpit region 45. Referring to FIG. 6, there is shown a detail view of the starboard rocker adjustment system 52 of FIG. 1. In a scheme similar to the keel locking and tensioning mechanism, the rocker adjustment system comprises an elongatable arrangement that is insertable between exposed forward and aft male portions 60 that protrude from the forward and aft hull sections past connections 35 into cockpit region 45 as extensions of the forward and aft gunwale member portions 22 and 32, respectively.

The rocker adjustment system 52 preferably comprises primary 110 and secondary 120 systems in which the primary system is used to set the rocker to a fixed setting when assembling the kayak and the secondary system is used to manually adjust the rocker after assembly of the kayak. It will be understood that a collapsible boat according to the present invention can be fitted with either the primary or secondary rocker adjustment systems alone. For maximum adjustment, it is preferable that the primary and secondary systems be installed in combination as illustrated in FIG. 6.

Primary rocker adjustment system 110 comprises an arm 111 and sleeve 112 arrangement to permit slidable movement of arm 111 within sleeve 112 to allow for adjustment in the length of the gunwale members and a locking mechanism 114 to lock the position of the arm with respect to the sleeve. Sleeve 112 engages with male portion 60 at the forward hull section to create a connection. Locking mechanism 114 comprises a plurality of pre-drilled holes 115 through sleeve 112 and a depressible protrusion or button 116 formed on arm 111 that is spring biased to protrude outwardly from the arm such that the protrusion will extend into a selected hole 115 to lock the sleeve and arm together on alignment of the opening and the protrusion.

Secondary rocker adjustment system 120 comprises a telescoping member 121 that is movable between extended and retracted positions. The telescoping member comprises an elongate tube 124 that has a first end 122 with a cavity to receive and retain male portion 60 of the aft gunwale member portion 32. A sleeve 125 is slidably mounted over the second end of the tube 124. In the illustrated embodiment in which the primary and secondary rocker systems are combined, the distal end of sleeve 125 includes the primary rocker adjustment system 110. In the event that the primary or secondary systems are used alone, appropriate cavities must be formed at both ends of each rocker adjustment system to receive and retain the protruding male portions 60 of the forward and aft hull sections.

A lever arm 127 is pivotally mounted to sleeve member 125 and includes a link 128 extending between the lever arm and the tubular member 124 such that pivotal movement of the lever arm through 180 degrees between position A and position B acts to move the sleeve along the elongate member to increase or decrease the length of the telescoping member. The end of lever arm 127 includes a locking clasp 130 for snap fit engagement with sleeve 125 or elongate tube 124 to lock the arm into position when it is moved to a position parallel to the sleeve or tube. Lever arm 127 is manually operated by a user sitting in the cockpit.

Figure 7:
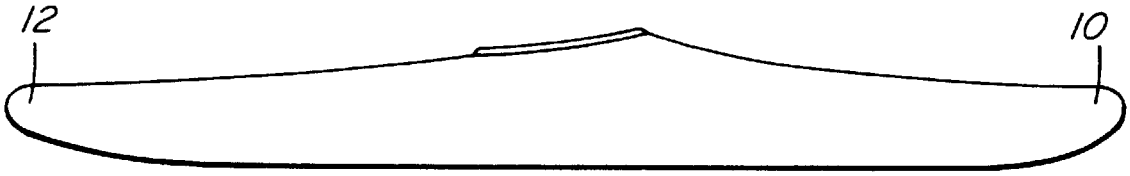
FIGS. 7–9 show the variation in keel curvature or rocker that is possible with rocker adjustment system of the present invention.
Figure 8:
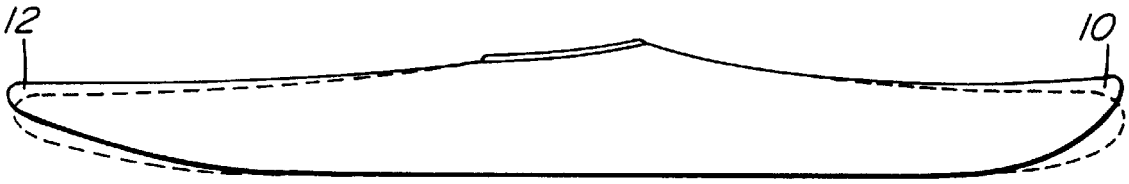
Figure 9:
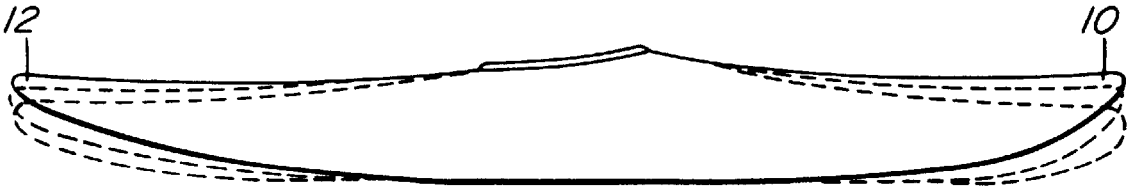

The primary and secondary rocker adjustment systems operate to change the length of the gunwale member. As the gunwale length shortens, the bow 10 and stern 12 of the boat rise thus increasing the rocker or curvature of the keel. The shorter the gunwale length, the higher the bow 10 and stern 12 and the greater the rocker. FIG. 7 shows a kayak with no rocker or keel curvature which is appropriate for flat water conditions to assist in keeping the kayak travelling in a straight line. FIGS. 8 and 9 show different rocker positions with an increasingly curved keel. In general, the greater the curvature or rocker of the keel, the greater the turning ability of the kayak hull.

When assembling the kayak, an initial primary rocker adjustment setting is selected and locked in by sliding sleeve 112 over arm 111 to engage button 116 in a pre-selected hole 115. By way of example, holes 115 can be half an inch apart and movement of button 116 between adjacent holes lengthens or shorten the gunwale by half an inch. The secondary rocker adjustment is varied by a kayaker in the cockpit moving lever 127 between forward position A and rearward position B. Position A causes the gunwale length to be set to the maximum length possible based on the primary rocker adjustment setting and therefore tends to lower the bow and stern from the rocker position set by the primary setting. Position B of the lever arm shortens the gunwale causing the bow and stern to rise.

Although the present invention has been described in some detail by way of example for purposes of clarity and understanding, it will be apparent that certain changes and modifications may be practised within the scope of the appended claims.

We claim:

1. A collapsible boat having a framework comprising:

forward and aft keel member portions;

forward and aft port and starboard gunwale member portions;

forward and aft port and starboard stringer member portions;

a plurality of transverse cross-rib members;

interconnecting means for joining of the keel, gunwale and stringer member portions into aligned longitudinal members joined at adjacent ends and for joining of the longitudinal members to the cross-rib members to define forward and aft hull sections;

a keel locking and tensioning mechanism to join together the forward and aft keel members and thereby the forward and aft hull sections to define a framework having elongate keel, gunwale and stringer members that extend longitudinally between a bow and stern and that are spaced and braced by the transverse cross-rib members; and a rocker adjustment system in the gunwale members to join together the forward and aft gunwale member portions and permit variation of the elevation of the bow and stern of the framework by adjusting the overall length of the gunwale members.

2. A collapsible boat as claimed in claim 1 including a flexible water impermeable layer for covering the framework, the layer being shaped to receive the forward and aft portions of the framework through a central cockpit opening for subsequent joining and locking.

3. A collapsible boat as claimed in claim 2 in which the layer includes an annular coaming member formed integrally with the layer and extending about perimeter of the central cockpit opening.

4. A collapsible boat as claimed in claim 3 in which the annular coaming member is flexible and formed with a releasable joint to allow the annular coaming member to be opened and spread apart to create an opening sufficiently large to receive the framework portions.

5. A collapsible boat as claimed in claim 4 in which the layer is formed with a gusset extending from the central cockpit opening at a point adjacent the releasable joint in the coaming member to provide excess material to allow for enlargement of the cockpit opening.

6. A collapsible boat as claimed in claim 2 in which the keel locking and tensioning mechanism comprises a telescoping member movable into an extended position to move the forward and aft portions of the framework apart into the ends of the layer to tauten the layer over the framework.

7. A collapsible boat as claimed in claim 1 in which the keel locking and tensioning mechanism comprises a telescoping member movable into extended and retracted positions having first and second ends with cavities to receive and retain the ends of the forward and aft keel members, the telescoping member being lockable into the extended position to join and tension the forward and aft keel members.

8. A collapsible boat as claimed in claim 7 in which the telescoping member comprises:

an elongate member defining the first end of the telescoping member;

a sleeve received on the elongate member for movement along the elongate member, the sleeve member defining the second end of the telescoping member;

a lever arm pivotally mounted to the elongate member and including a link extending between the lever arm and the sleeve such that pivotal movement of the lever arm acts to move the sleeve along the elongate member to increase or decrease the length of the telescoping member;

a locking pin; and holes formed in the lever arm and the sleeve that are alignable to receive the locking pin to lock the telescoping member in the extended position.

9. A collapsible boat as claimed in claim 1 in which the keel, gunwale, stringer and cross-rib members are lightweight hollow tubes.

10. A collapsible boat as claimed in claim 1 in which the interconnecting means comprise:

one end of a first portion of a longitudinal member having a male portion and an adjacent end of a second portion of the longitudinal member having a complementary opening to serve as the female portion to receive the male portion therein; and a sleeve portion adapted to be slidably received on the male portion having tubes extending therefrom to receive the cross-rib member.

11. A collapsible boat as claimed in claim 10 including a locking mechanism to join the male and female portions of the interconnecting means.

12. A collapsible boat as claimed in claim 11 in which the locking mechanism comprises an opening in the female portion and a depressible protrusion formed on the male portion spring biased to protrude outwardly from the male portion such that the protrusion extends into the opening to lock the male and female portion together on alignment of the opening and the protrusion.

13. A collapsible boat as claimed in claim 10 in which the sleeve portion is mounted between the male and female portions and the male and female portions are formed with flanges that co-operate to define a region therebetween to limit movement of the sleeve portion.

14. A collapsible boat as claimed in claim 1 in which the rocker adjustment system comprises:

an arm and sleeve arrangement formed in the port and starboard gunwale members to permit slidable movement of the arm within the sleeve to allow for adjustment in the length of the gunwale members; and a locking mechanism to lock the position of the arm with respect to the sleeve.

15. A collapsible boat as claimed in claim 14 in which the locking mechanism comprises:

a plurality of openings in the sleeve and a depressible protrusion formed on the arm spring biased to protrude outwardly from the arm such that the protrusion extends into one of the openings to lock the sleeve and arm together on alignment of the opening and the protrusion.

16. A collapsible boat as claimed in claim 1 in which the rocker adjustment system comprises:

a telescoping member insertable into the port and starboard gunwale members, each telescoping member being movable into extended and retracted positions and having first and second ends with cavities to receive and retain the ends of the forward and aft gunwale members, and each telescoping member being lockable into the extended or retracted position to vary the length of the gunwale members.

17. A collapsible boat as claimed in claim 16 in which the telescoping member comprises:

an elongate member defining the first end of the telescoping member;

a sleeve received on the elongate member for movement along the elongate member, the sleeve member defining the second end of the telescoping member;

a lever arm pivotally mounted to the sleeve member and including a link extending between the lever arm and the elongate member such that pivotal movement of the lever arm acts to move the sleeve along the elongate member to increase or decrease the length of the telescoping member; and a lock at the end of the lever arm for snap fit engagement with the sleeve or the elongate member when the lever arm is moved to a position parallel to the sleeve or elongate member to lock the telescoping member into the extended or retracted position.

18. A collapsible boat as claimed in claim 1 which the rocker arm adjustment system includes a primary rocker adjustment system to set the rocker to a fixed setting when assembling the boat and a secondary rocker adjustment system to permit adjustment of the rocker after assembly of the boat.

19. A collapsible boat as claimed in claim 18 in which the primary rocker adjustment system comprises:

an arm and sleeve arrangement formed in the port and starboard gunwale members to permit slidable movement of the arm within the sleeve to allow for adjustment in the length of the gunwale members; and a locking mechanism to lock the position of the arm with respect to the sleeve.

20. A collapsible boat as claimed in claim 19 in which the secondary rocker adjustment system comprises:

a telescoping member insertable into the port and starboard gunwale members, each telescoping member being movable into extended and retracted positions and having first and second ends with cavities to receive and retain the ends of the forward and aft gunwale members, and each telescoping member being actuatable from the cockpit of the assembled boat and lockable into the extended or retracted position to vary the length of the gunwale members.

21. A collapsible boat as claimed in claim 1 including forward and aft deck member portions mountable between the port and starboard gunwale members.

* * * * *